US007889147B2

(12) United States Patent
Tam et al.

(10) Patent No.: US 7,889,147 B2
(45) Date of Patent: Feb. 15, 2011

(54) MODULAR ACTIVE PHASED ARRAY

(75) Inventors: Jason Tam, Bethesda, MD (US); Jeff Joseph Dickstein, Ellicott City, MD (US); Lawrence Ronald Heitzmann, Clarksville, MD (US); Andrew Donald Meekins, Baltimore, MD (US); Michael Aleksandrovich Dumesh, Columbia, MD (US); Daniel David Anderson, Derby, KS (US); Stephen James Essman, Laurel, MD (US); Michael Anthony Hahn, Elkridge, MD (US); Dave Baldacci, Catonsville, MD (US)

(73) Assignee: Northrop Grumman Systems Corporation, Los Angeles, CA (US)

( * ) Notice: Subject to any disclaimer, the term of this patent is extended or adjusted under 35 U.S.C. 154(b) by 950 days.

(21) Appl. No.: 11/678,385

(22) Filed: Feb. 23, 2007

(65) Prior Publication Data

US 2008/0204350 A1 Aug. 28, 2008

(51) Int. Cl.
*H01Q 13/00* (2006.01)

(52) U.S. Cl. ..... 343/777; 343/700 MS; 343/872

(58) Field of Classification Search ..... 343/700 MS, 343/853, 893, 878, 890, 776, 777, 872
See application file for complete search history.

(56) References Cited

U.S. PATENT DOCUMENTS

| | | | | |
|---|---|---|---|---|
| 4,494,350 | A * | 1/1985 | Sharp | 52/665 |
| 4,816,835 | A * | 3/1989 | Abiko et al. | 343/700 MS |
| 4,959,658 | A | 9/1990 | Collins | |
| 5,086,304 | A | 2/1992 | Collins | |
| 5,268,701 | A | 12/1993 | Smith | |
| 5,276,455 | A | 1/1994 | Fitzsimmons et al. | |
| 5,293,171 | A | 3/1994 | Cherrette | |
| 5,327,152 | A | 7/1994 | Kruger et al. | |
| 5,431,582 | A | 7/1995 | Carvalho et al. | |
| 5,457,607 | A | 10/1995 | Carvalho | |
| 5,666,128 | A | 9/1997 | Murray et al. | |
| 5,854,607 | A | 12/1998 | Kinghorn | |
| 5,870,063 | A | 2/1999 | Cherrette et al. | |
| 5,907,304 | A | 5/1999 | Wilson et al. | |
| 5,940,031 | A | 8/1999 | Turlington et al. | |
| 5,969,693 | A * | 10/1999 | Legg | 343/890 |
| 6,005,531 | A * | 12/1999 | Cassen et al. | 343/853 |
| 6,184,832 | B1 | 2/2001 | Geyh et al. | |
| 6,239,766 | B1 | 5/2001 | Smith et al. | |
| 6,597,902 | B1 | 7/2003 | Kawano | |
| 6,624,787 | B2 | 9/2003 | Puzella et al. | |
| 6,703,976 | B2 | 3/2004 | Jacomb-Hood et al. | |
| 7,132,990 | B2 | 11/2006 | Stenger et al. | |
| 2005/0110681 | A1 | 5/2005 | Londre | |

* cited by examiner

*Primary Examiner*—Douglas W Owens
*Assistant Examiner*—Dieu Hien T Duong
(74) *Attorney, Agent, or Firm*—Rothwell, Figg, Ernst & Manbeck, p.c.

(57) ABSTRACT

A structural grid is provided with continuous and discontinuous beam members coupled by splices, a front structure coupled to the structural grid, the front structure including a walkway and cables, a radome coupled to the front structure. The structural grid is coupled to a plurality of antenna subassemblies. The antenna subassemblies have a forward housing including an RF manifold coupled to a circulator, an aft housing coupled to the forward housing, containing a line replaceable unit that is serviceable or maintainable through the aft housing.

25 Claims, 10 Drawing Sheets

MODULAR ACTIVE PHASED ARRAY

BACKGROUND OF THE INVENTION

1. Technical Field

The present invention relates to an antenna array or assembly of arrays. More particularly, the present invention relates to modular, active phased antenna arrays.

2. Description of the Background Art

A phased array includes an array of radiating elements, or radiators, whose signals are controlled by a beamformer to produce an antenna beam pattern that may be steered, or scanned, in different directions. Phased array technology was originally developed for unidirectional, receive-only applications, such as radio astronomy, and then extended to bidirectional, transmit and receive applications, such as radar.

In a passive phased array, each radiator is coupled to a passive antenna module. For example, a passive electronically scanned array (PESA) is a bidirectional, passive phased array in which a radio frequency (RF) source provides a constant-phase, high-power transmit (Tx) signal to each passive antenna (or phase shift) module. In an active phased array, each radiator is coupled to an "active" antenna module. For example, an active electronically scanned array (AESA) is a bidirectional, active phased array in which an RF source provides a low-power Tx signal to each active, transmit/receive (T/R) module. One AESA application is the United States Navy's Cobra Judy program, which is a multi-story, data collection sensor mounted on the USNS Observation Island that is used, inter alia, to ensure compliance with various international treaties.

These radar systems can be very expensive, and one important cost component is replacement parts. Like the Navy's Cobra Judy program, AESAs have been adapted to a variety of military applications, and are, consequently, subject to hazardous environmental conditions. For example, a shipboard AESA may be subjected to severe weather as well as enemy fire, and if the AESA is damaged, the entire antenna is likely to stop functioning, which necessitates the replacement of the damaged component(s). Beyond the cost of replacing the entire component, a technician will oftentimes need to wait until the AESA can be dismantled in order for the damaged component to be replaced. Unfortunately, AESA repair typically occurs in-port, which may severely impact time-on-station. For certain applications, AESA data is most crucial when weather conditions are the harshest, and a system that can be repaired at sea, and at a reasonable cost, would greatly reduce this loss of time on-station.

SUMMARY OF THE INVENTION

Embodiments of the present invention provide a structural grid with continuous and discontinuous beam members coupled by splices. This grid provides a lattice work for a plurality of antenna subassemblies and is coupled to the front structure while including a walkway, cables, and a radome. The antenna assemblies have a forward housing including an RF manifold coupled to a circulator, an aft housing coupled to the forward housing, containing a line replaceable unit that is reachable through the aft housing.

BRIEF DESCRIPTION OF THE DRAWINGS

The same part of an invention appearing in more than one view of the drawing is always designated by the same reference character

DETAILED DESCRIPTION OF THE PREFERRED EMBODIMENTS

Figure 1:
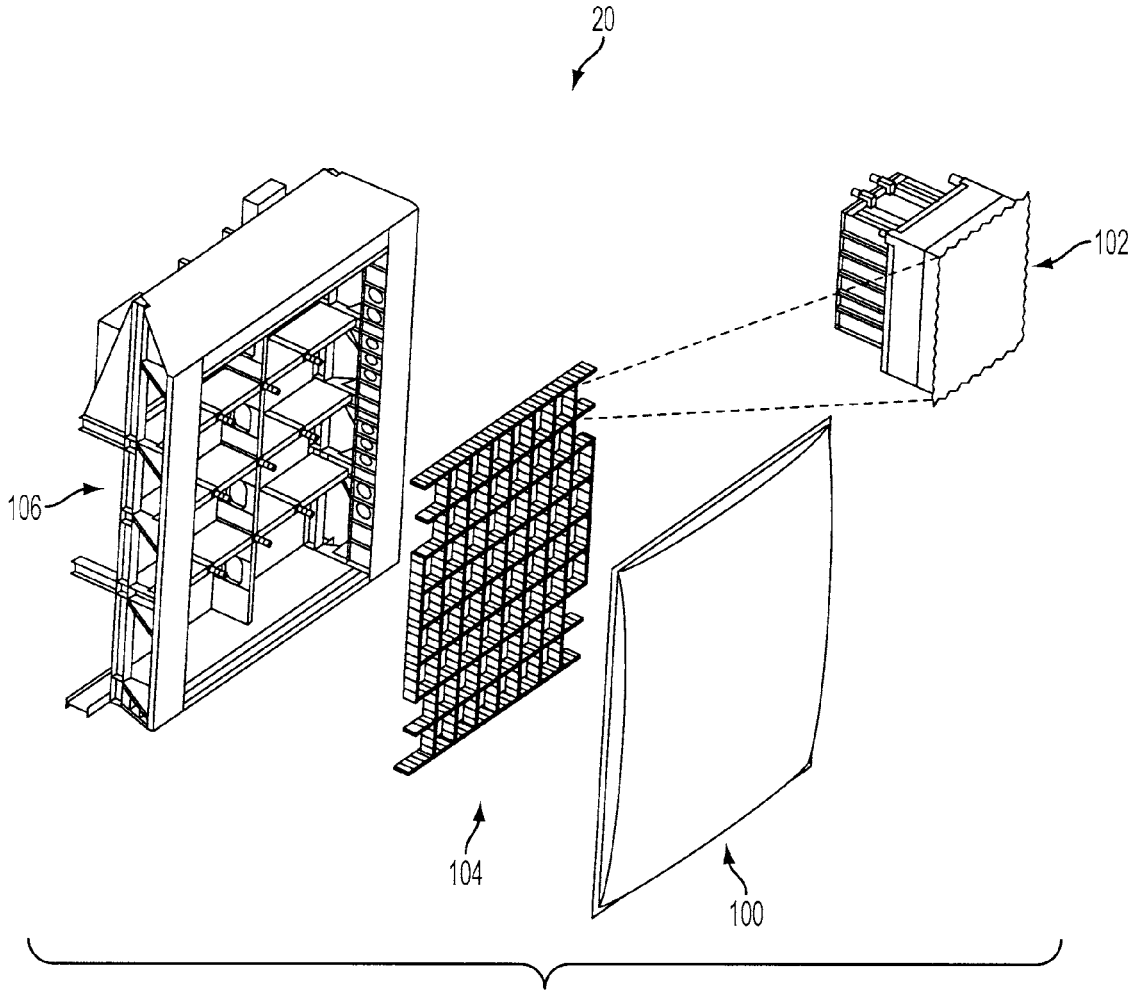
FIG. 1 is an exploded view of an antenna assembly according to an embodiment of the present invention.

FIG. 1 shows a novel antenna assembly 20 according to an embodiment of the present invention. In a preferred embodiment, not shown, the antenna assembly 20 may be mounted on a ship. The antenna assembly 20 includes a steel front structure 106 that provides a system of walkways 502 and, optionally, bulkheads 500 which allow technicians to access various parts of the array. This embodiment of an antenna assembly 20 also includes an aluminum structural grid 104 is attached to the front structure 106. The structural grid 104 is a system of beam members 300 and 302 forming an array of rectangles. Each rectangle is sized to fit an antenna subassembly 102. The antenna subassemblies 102 have a forward housing, made up of both a lower forward housing 202 and an upper forward housing 204. An aft housing 206 is attached to the rear of the upper forward housing 204. A patch radiator 200 is secured to the front of the lower forward housing 202. A radome 100 is attached to the face of an antenna assembly 20 and covers the grid of antenna subassemblies 102 housed in the antenna assembly 20.

FIG. 1 depicts a radome 100. Radomes are weatherproof covers for radar installations, and protect the antenna along with the antenna electronics. Though the term radome, which comes from a combination of radar and dome, often refers to a semi-spherical shaped apparatus, the radome 100 shown in FIG. 1 has a non circular curvature. In one embodiment, a radome 100 is coupled to the front structure 106. Such a radome 100 helps protect the antenna assembly from the naval environment, including damage from rain, snow, sleet, wind, and water. One particular concern is the accumulation of freezing ice on the radar electronics. Therefore, a radome 100 may have coatings to allow for anti-icing, water repulsion, or other types of weather proofing, and there may be multiple coatings. Precipitation is more likely to fall off of the radome 100 because it is vertically mounted. By covering these electronics, the radome 100 prevents damage from the freezing rain.

The radome 100 is shaped to cover the front of the antenna assembly, and may be square, or rectangular. A radome 100 may be constructed with fiberglass and foam. The fiberglass may form a honeycomb pattern and sheets of fiberglass may be laminated to form a sandwich construction radome 100, or the skin may be made of Styrofoam/Teflon®. The honeycomb core may be filled with closed cell foam, Nomex® or another type of foam.

A radome 100 may need to meet structural and/or radio frequency (RF) requirements. The structural requirements are important because certain radomes 100 may be subjected to a variety of elemental conditions. For example, a radome 100 may be over forty feet high, and thus its design must meet structural requirements to not only support its own weight, but also to be attached to the antenna installation. The RF requirements are important because the radome 100 covers the antenna. Therefore, when the antenna transmits and receives RF signals, these signals must pass through the radome 100. Ideally, a radome 100 will not interfere with, i.e. will have zero effect on, the incoming and outgoing signals. However, radomes 100 will generally have some amount of transmission loss, often due to the frame blockage, e.g., the fiberglass in a radome 100 physically blocks the radio signals, or loss due to loss in the membrane, e.g. the foam filled core absorbs the radio signals. Which materials are chosen, and what shape these materials are manufactured in, may impact these transmission characteristics. For example, it may be possible to reduce reflections by making the honeycomb core a quarter wave electrical thickness of the operating frequency. Further, a radome 100 may be designed to meet certain structural and RF requirements while being optimized for minimal overall skin thickness.

Figure 2:
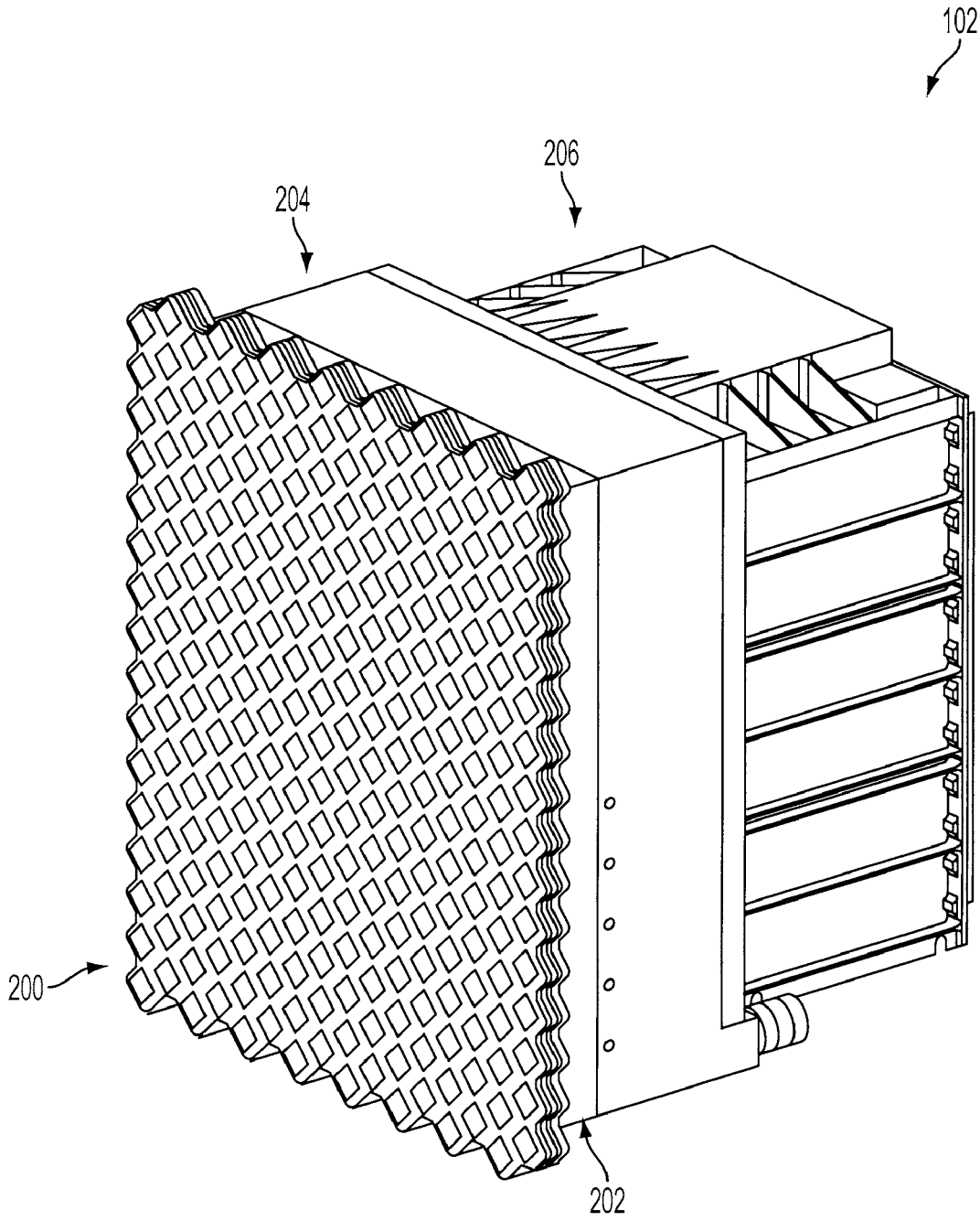
FIG. 2 is an isometric view of an antenna subassembly for use in an antenna assembly according to an embodiment of the present invention.

FIG. 2 depicts an antenna subassembly 102. The antenna subassembly 102 has a forward housing which contains the transmit and receive functionality. The lower forward housing 202 is secured against the upper forward housing 204. A patch radiator is provided on the front of the lower forward housing 202, and the aft housing 206 is secured to the back of the upper forward housing 204. The aft housing 206 provides electronics which communicate the received signals and process the transmission commands.

An antenna subassembly 102 has a forward housing, which is approximately a rectangular prism. This way, the antenna subassembly 102 may fit more easily into a grid than an antenna with an oval shaped housing, which may be better suited for the nose of an airplane. The forward housing may be designed to be attached to the front structure 106, such as by being snapped into place with a structure attached to an I-beam. For example, the forward housing may have an assembly ledge which may be secured to the front structure 106.

Figure 3:
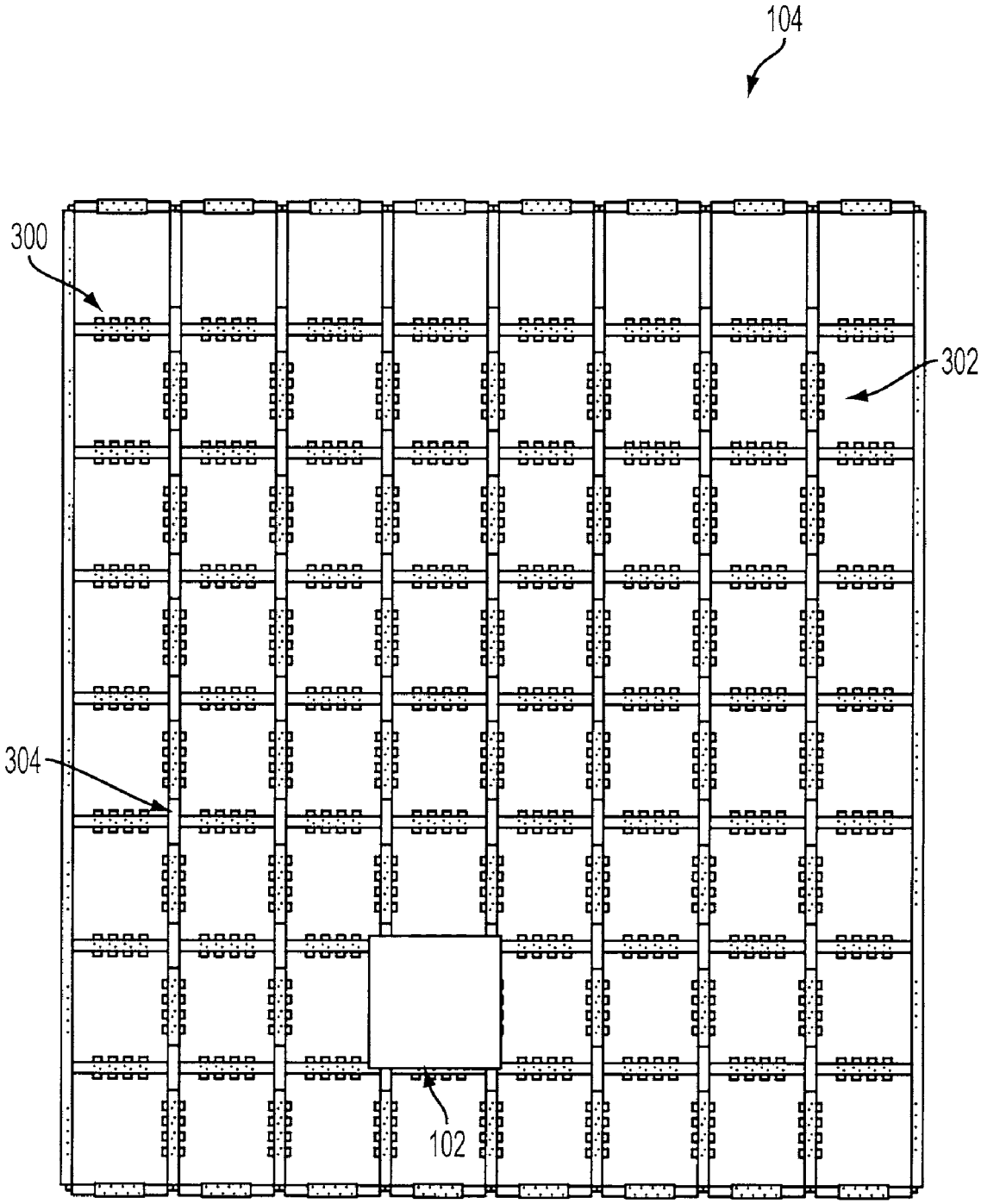
FIG. 3 is a plan view of a structural grid for use in an antenna assembly according to an embodiment of the present invention.

As shown in FIG. 3, a structural grid 104 is employed to support modular antenna subassemblies 102. The antenna subassemblies 102 can be assembled together on the structural grid 104 to function as a larger antenna. The structural grid 104 aligns each of the antenna subassemblies 102 with each other. The structural grid 104 may support 60 antenna subassemblies 102, i.e., a grid of 64 rectangles, with the four corner rectangles being empty, or there may be a complete grid of 64 antenna subassemblies 102. In certain embodiments, some of the outer borders of the structural grid 104 are not added.

Figure 4:
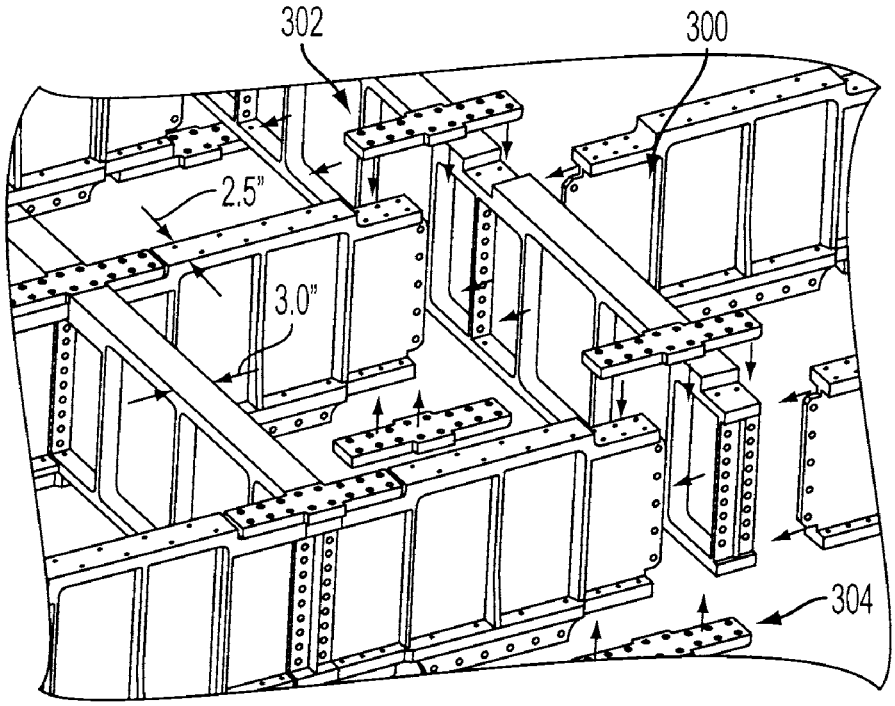
FIG. 4 is an isometric exploded detail view of a structural grid for use in an antenna assembly according to an embodiment of the present invention.

FIG. 4 depicts a structural grid 104, which is formed of continuous beam members 302, splice members 304 and discontinuous beam members 300. The continuous beam members 302 may all be identical. The continuous beam members 302 may be placed horizontally. The discontinuous beam members 300 may all be identical. The discontinuous beam members 300 may be placed vertically. Each continuous beam member 302 is perpendicular to a discontinuous beam member 300, and in some embodiments, the continuous and discontinuous beam members 300 and 302 may be substantially perpendicular. A discontinuous beam member 300 may be the length of one square, and a continuous beam member 302 may extend for multiple squares of the structural grid 104.

Discontinuous beam members 300 are coupled together in a line, whereas continuous beam members 302 are aligned side by side. Four splices 304 may be placed along, and extending from, each of the ends of the top and bottom sides. A splice 304 may be a beam splice, flange plate or connector plate. Each of the four splices 304 is constructed such that it crosses over the top of, or under, the bottom of the continuous beam 302. The continuous beam 302 may have a notch to allow the splice 304 to pass over or under. The splices 304 are bolted, riveted, screwed, welded or otherwise secured to the beam members 300 and 302.

The continuous beam members 302 and discontinuous beam members 300 may have the same height, but different widths. In such an embodiment, the beam members may be 11 inches high, the continuous beam members 302 may be 3 inches thick, and the discontinuous beam members 300 may be 2.5 inches thick. The beam members 300 and 302 may be I-beams, i.e. a beam with an I or H shaped cross section, or box beams. The beam members 300 and 302 may have ribbing to provide added structural support. The beam members 300 and 302 may be constructed of steel or aluminum, such as 6061-T6. The beam members 300 and 302 may have a hollow structural section or a lightening hole. Cutting away parts of an I-beam reduces the weight, and this may be advantageous for mounting on a ship.

The antenna subassemblies 102 are fastened directly to the beam members 300 and 302. In various embodiments, different size antenna subassemblies 102 may be used. The lengths of the beam members 300 and 302 may be chosen to accommodate the size and number of the antenna subassemblies 102. Aluminum spars may be bolted to the outside of the structural grid 104. These spars help couple a structural grid 104 to a front structure 106.

A front structure 106 may be coupled to a structural grid 104. The skeleton of the front structure 106 may be constructed to attach to a positioner mechanism, and the front structure 106 may also have a radome 100 bolted on front. A front structure 106 may be built with support beams to ensure that the front structure 106 can withstand a Naval environment, including concerns such as gale force winds and heavy rocking. In certain embodiments, a front structure 106 is constructed of welded steel, and is large enough to house all of the antenna subassemblies 102 and the structural grid 104. With other embodiments, there may be multiple antenna arrays, such that some antenna subassemblies 102 are housed in a first front structure 106 and others are housed in a second front structure 106. In various embodiments, the front structure 106 may be designed to be different sizes, in order to accommodate various antenna systems. For example, a front structure 106 that needs to support 120 antenna subassemblies 102 may be larger than a front structure 106 that only supports 30 individual antennas. Conversely, a front structure 106 may be sized based on the shape of the antenna subassemblies 102 that will be supported.

Figure 5:
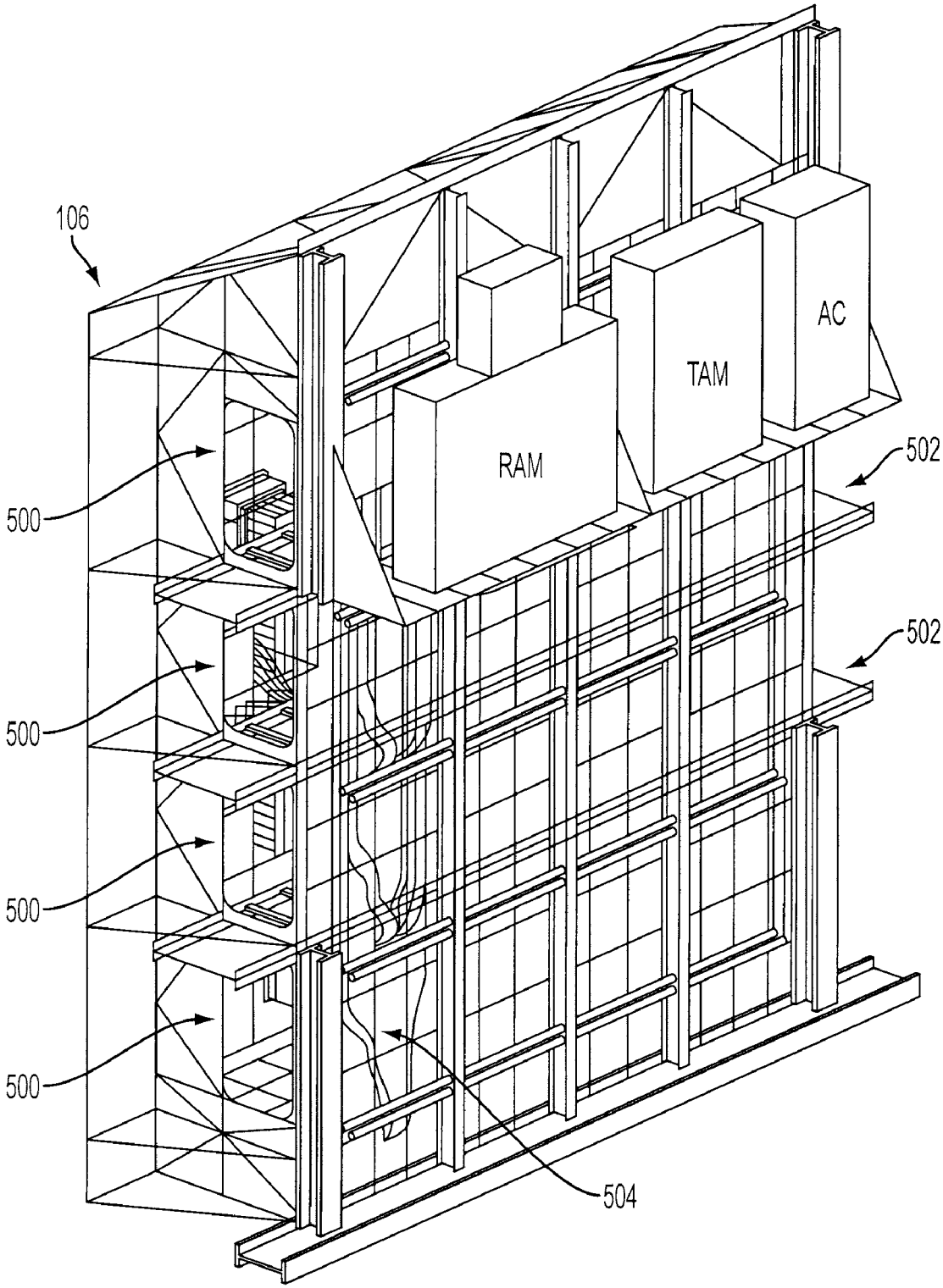
FIG. 5 is a rear facing high three quarter view of a front structure for use in an antenna assembly according to an embodiment of the present invention.

FIG. 5 shows the rear of a front structure. The antenna subassemblies 102 may require a variety of power cables, information cables, power filter racks, RF filtering, and other connections 504. Additionally, a number of pipes may also be employed to provide coolants for the antenna subassemblies 102. The rear of the front structure 106 may have a system of bulkheads 500, which provide structural support to the front structure 106. The bulkheads 500 may prevent the spread of fire, a potential concern in a naval environment, by physically partitioning areas. The bulkheads 500 may be electrically grounded to prevent electromagnetic interference.

The rear of the front structure 106 may have a system of walkways 502, which provide access to each of the antenna subassemblies 102. A technician may walk, climb or otherwise be transported up to the appropriate walkway 502 and travel along the walkway 502 until they have reached the antenna subassemblies 102 in question. In doing so, a technician may pass through bulkheads 500 while crossing the walkway 502. In certain embodiments, a walkway 502 may connect to an elevator or other transportation mechanism. By using a walkway 502, the technician may have direct access to the back of the antenna subassemblies 102, thus allowing the technician to remove the rear removable cover 1000 from the aft housing 206 and proceed to service the antenna subassemblies 102. The antenna subassemblies 102 may be placed vertically, such that multiple antennas are within reach from a single spot on a walkway 502. The walkways 502 and the bulkheads 500 may support the variety of connections 504 for the antenna subassemblies 102. For example, the pipes which provide coolant may be hung from the underside of each walkway 502, or the various cables may be bundled and strung up a bulkhead 500. In such an embodiment, antenna electronics may be in communication with antenna subassemblies 102 without obstructing a technician's access to an antenna subassembly 102. Some of the cables may be corrugated, semi-rigid coaxial cables to provide a ruggedized receiver interconnection.

Figure 6:
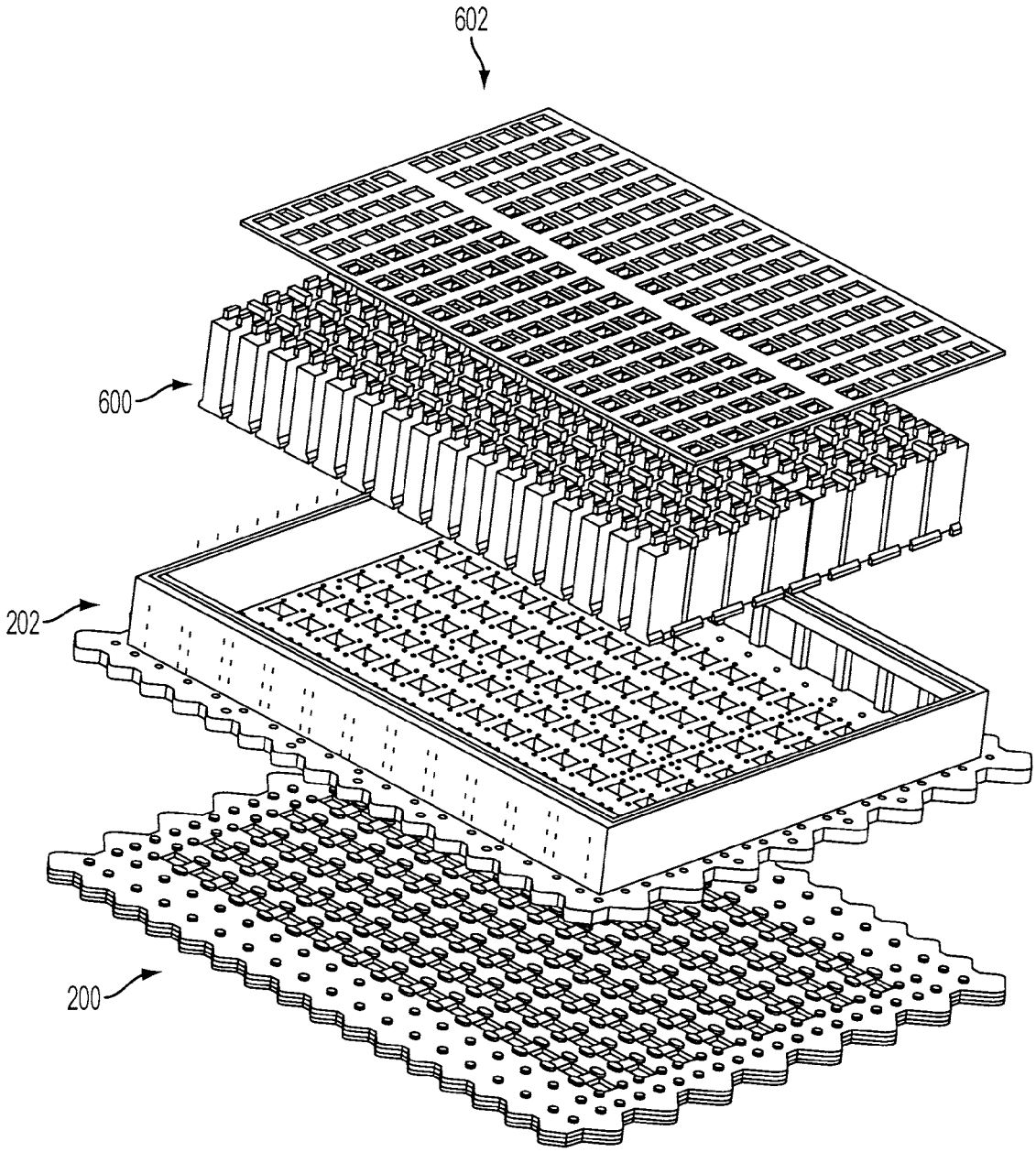
FIG. 6 is an isometric exploded view of a lower forward housing for use in an antenna subassembly according to an embodiment of the present invention.

FIG. 6 depicts a lower forward housing 202 which has a passive radiator. The passive radiator radiates a signal coming from the active module, in phase, such that the total signal transmitted in a given direction is increased. The radiator may be ruggedized, such as for a naval environment. A patch radiator 200, a type of passive radiator, may be formed by placing microstrip metallization onto the radiator surface. Microstrip antennas may be formed by etching a metallized pattern onto a substrate and then bonding various substrate stacks together. In various embodiments, the patches may be rectangular, triangular, circular or other geometric shapes. The patches may be laid out in a triangular or rectangular grid.

The radiator 200 may be polarized. Polarization of a transverse wave, such as a radio wave, describes the direction of oscillation in the plane perpendicular to the direction of travel. A probe feed may be oriented horizontally, thus providing horizontal polarization. A probe feed may be oriented vertically, thus providing vertical polarization. Slits or holes may be cut to provide circular polarization. The radiator 200 may have both horizontal and vertical polarizations, thereby becoming dual polarization. Energizing both in different combinations may provide any linear and any circular polarization.

The radiator 200 may have multiple layers of dielectric. In various embodiments, the dielectrics may be foam, air, Teflon® or fiberglass. Patch radiators are often made with multiple layers. In such an embodiment, the first layers may be comprised of etched patches in dielectric, while the rest of the layers include feeding networks and necessary stripline lengths etched in dielectric to allow connection to the next radio frequency components. All layers may be supported by the subassembly 102 housing.

A phase center is the point from which an electromagnetic wave emanates. Many antennas, such as microstrip, patch, or dish antennas will not have a single point from which the signal begins. However, one is still able to calculate an apparent phase center from a given point. The radiator 200 may have dual polarization whose two polarizations occur next to each other. The signals from this radiator would emanate a non-coincident phase center. The radiator 200 may have dual polarization whose two polarizations overlap or are otherwise centered in the same location. The signals from this radiator would emanate a coincident phase center. Active transmit/receive modules 700 may provide different electrical signals based on the desired polarization of the signal that they will transmit. The radiator 200 with coincident phase center allows for easier polarization generation.

The forward housing may be comprised of a lower forward housing 202 and an upper forward housing 204. The lower forward housing 202 supports and locates the circulators 600 and the patch radiator 200. The patch radiator 200 is mounted on the outside of the lower forward housing 202 while the circulators 600 are inside the lower forward housing 202. The lower forward housing 202 is formed by a flat rectangular piece which has a plurality of perpendicular members attached to one side to form walls. There are four walls placed to form a rectangle. In this way, the circulators 600 are enclosed by the four walls. The lower forward housing 202 may be able to be separated from the upper forward housing 204, e.g. by turning screws or physically separating interlocking components. In such an embodiment, a technician may be able to access the circulators 600 without needing to drain the cooling system.

The lower forward housing 202 may also contain an RF manifold 602 behind the circulators 600, i.e., the circulators 600 are facing the patch radiator 200, and the manifold 602 is on the other side. The RF manifold 602 has a patterned array of rectangular openings. An RF connector fits through one of these openings in the RF manifold 602, so that a transmit/receive module 700 can attach to an RF connector. The RF connector couples a transmit/receive module 700 to a circulator 600, and the RF connector also electrically connects the transmit/receive module 700 to various layers of an RF manifold 602. The various layers are mutually insulated from each other. The insulators may insulate against heat, electricity, electromagnetic signals and other types of interference. An RF manifold 602 may be comprised of a plurality of contiguous RF strip line microwave conductor board members which are mutually insulated from one another and include RF coupler sections which abut a pair of relatively shorter tubular coupler members, and which are also adapted to couple transmit RF and receive RF to and from a transmit/receive module 700.

The RF manifold 602 has separate layers for transmit and receive signals. The RF connector connects the transmit/receive module 700 to the transmit and receive layers such that control signals may be sent to or from the transmit/receive module 700 via the RF manifold 602. For example, an RF pulse may be sent across the transmit layer of the RF manifold 602 to the transmit/receive module 700 via the RF connector. In such an embodiment, an array driver may be used before transmitting the RF signal. Another example is a transmit/receive module 700 that receives an incoming RF signal and transmits it to the radar system via the RF connector and the receive layer of the RF manifold 602.

A lower forward housing 202 encloses RF circulators 600. An RF circulator 600 is a three-port passive device used to control the direction of signal flow in a circuit. An RF circulator 600 may be connected between a transmit/receive module 700 and a patch radiator 200. Using modular RF circulators 600 reduces component cost, design effort and simplifies maintenance. The RF circulator 600 provides a path for an RF signal which has been received by an antenna element to proceed to the transmit/receive module 700. A pair of adjacent RF circulators 600 may be connected to a given RF connector.

Figure 7:
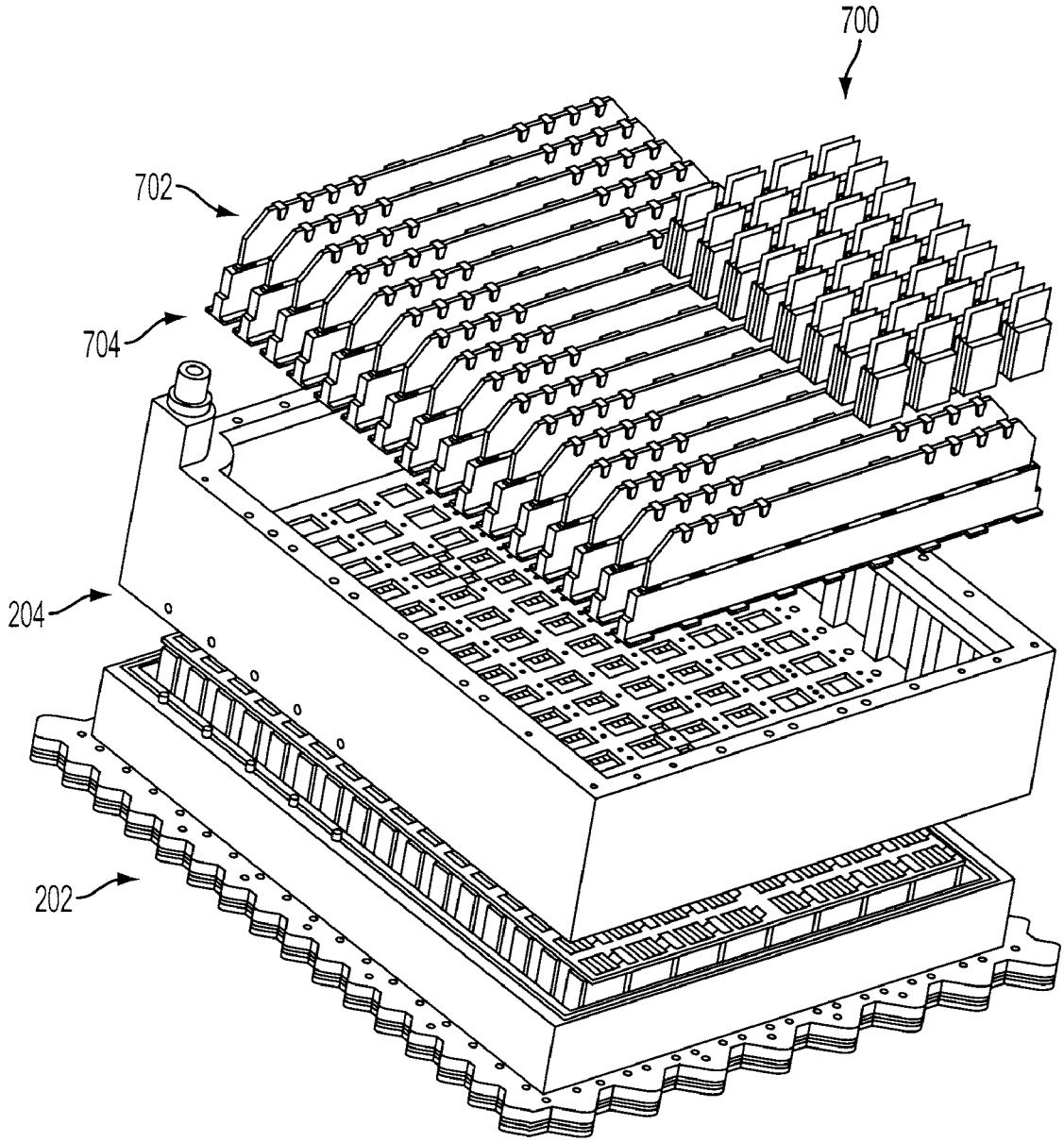
FIG. 7 is an isometric exploded view of an upper forward housing for use in an antenna subassembly according to an embodiment of the present invention.

FIG. 7 shows an upper forward housing 204, which has a generally planar section with an arrayed pattern of rectangular holes. The planar section is connected to a plurality of perpendicular members, forming four walls. In one embodiment, the both the planar section and the four walls are formed as a single piece. The four walls have the same perimeter as the four walls of the lower forward housing 202. This way, the four walls of the upper forward housing 204 may be able fit onto the four walls of the lower forward housing 202. The four walls may have holes such that they can be secured to the lower forward housing 202.

The upper forward housing 204 contains coldplates 704, power logic boards 702 and transmit/receive modules 700. A coldplate 704 is connected to a coolant distribution manifold, including a coolant inlet and outlet. The coldplate 704 is elongated and designed to circulate liquid coolant via conduits inside the coldplate 704. The conduits are designed, for example, to prevent interior transmit/receive modules 700 from heating more than the transmit/receive modules 700 located closer to the walls of the upper forward housing 204. The coldplates 704 are secured to a transmit/receive module 700 such that the flow of liquid coolant draws away heat generated by the transmit/receive modules 700. The coldplates 704 may be secured to the transmit/receive modules 700 with a wedgelock, for example, such that tightening the screws of the wedgelock forces the coldplate 704 into close contact with a heat sink plate located on the bottom of the transmit/receive module 700. Here, the wedgelock functions as a removable retainer assembly. The wedgelocks may be relatively inexpensive, as compared to the cost of the antenna subassembly 102.

The upper forward housing 204 may contain power logic boards 702, each of which is located adjacent and coextensive to a coldplate 704. The power logic board 702 couples a transmit/receive module 700 to all electrical signals that are not RF signals and conveys logic signals from the transmit/receive modules 700 to aft electronics (discussed elsewhere). The power logic board 702 is coupled to an individual bus bar, and there is one bus bar assembly for each high and low voltage power supply.

The upper forward housing 204 may contain identical transmit/receive modules 700 in an array. The transmit/receive modules 700 are designed to support S-band signals, e.g. 2-4 GHz microwaves, and are designed for high power applications. There are 16 transmit/receive modules 700 per coldplate 704. A transmit/receive module 700 generates transmit power, and performs low noise amplification of received signals coupled to and received from a respective radiating element. The transmit/receive module 700 progressively phase shifts transmitted signals for beam steering, and includes variable gain setting for aperture weighting during receive mode.

The forward housing may be designed for redundancy. For example, each antenna subassembly 102 assembly may contain four separate, individual subarrays. In such an embodiment, each subarray is functionally independent of every other subarray. If one subarray fails, the other subarrays continue functioning. With such an embodiment, a technician may be able to delay needing to perform repairs on the individual antenna 102.

An antenna subassembly 102 may be designed to be added to an active electronically scanned array (AESA). An active module may generate an electromagnetic signal with gallium-arsenide using less electricity than traditional sources. With the present invention, if a transmit/receive module 700 fails, other modules 700 may be unaffected. Thus, if such a transmit/receive module 700 were struck by enemy fire, other modules 700 in the array would continue to transmit and receive RF signals, and the antenna subassembly 102 would continue to function. Further, an antenna subassembly 102 may be modular, such that if one breaks, a replacement is less expensive and easier to find. An antenna assembly may be comprised of identical antenna subassemblies 102.

Antenna subassemblies 102 may allow for simplified attachment to a coolant quick disconnect system. Quick disconnect functionality improves the modularity of antenna subassemblies 102. A quick disconnect system has coolant running through plastic or rubber hoses. A hose connected to an antenna subassembly 102 needs to mate with a hose that delivers or removes coolant. The term quick disconnect encompasses connections made with friction, such as an interference fit. For example, the antenna subassembly's 102 hose may terminate with an o-ring. The o-ring is sized to be forced past and onto a sealing face, even though it may be square, cross or another shape. The o-ring experiences some deformation, which keeps the hoses locked together, and the connection sealed. O-ring material is often selected based on chemical compatibility, application temperature, sealing pressure, lubrication requirements, quality, quantity and cost. The material may be a synthetic rubber, such as a thermoset, or a thermoplastic.

The active modules generate electromagnetic signals with a variety of phases, selected such that the signal generated is stronger in one direction. Preferably, waves in one direction add together constructively, while waves in a less optimal direction tend to subtract from each other destructively. The phase selected for a particular transmit/receive module 700 may be changed electronically, for example, antenna electronics may be used to change the phase of all, or at least a plurality of modules 700 in an array. In such an embodiment, the antenna electronics may shift all of the phases such that the electromagnetic signals are focused in a new direction. This may be done repeatedly, such that the direction that the radar is detecting can be swept back and forth, or up and down, e.g. azimuth or elevation scanning. The direction of the antenna may also be altered mechanically, e.g. by hydraulics or with hinge appendages. One example would be an AESA mounted on a positioner mechanism, because the positioner mechanism may point the front structure 106 in a given direction, while at the same time, antenna electronics may control the phases of different transmit/receive modules 700 to further adjust the final direction of the radar beam.

Figure 8:
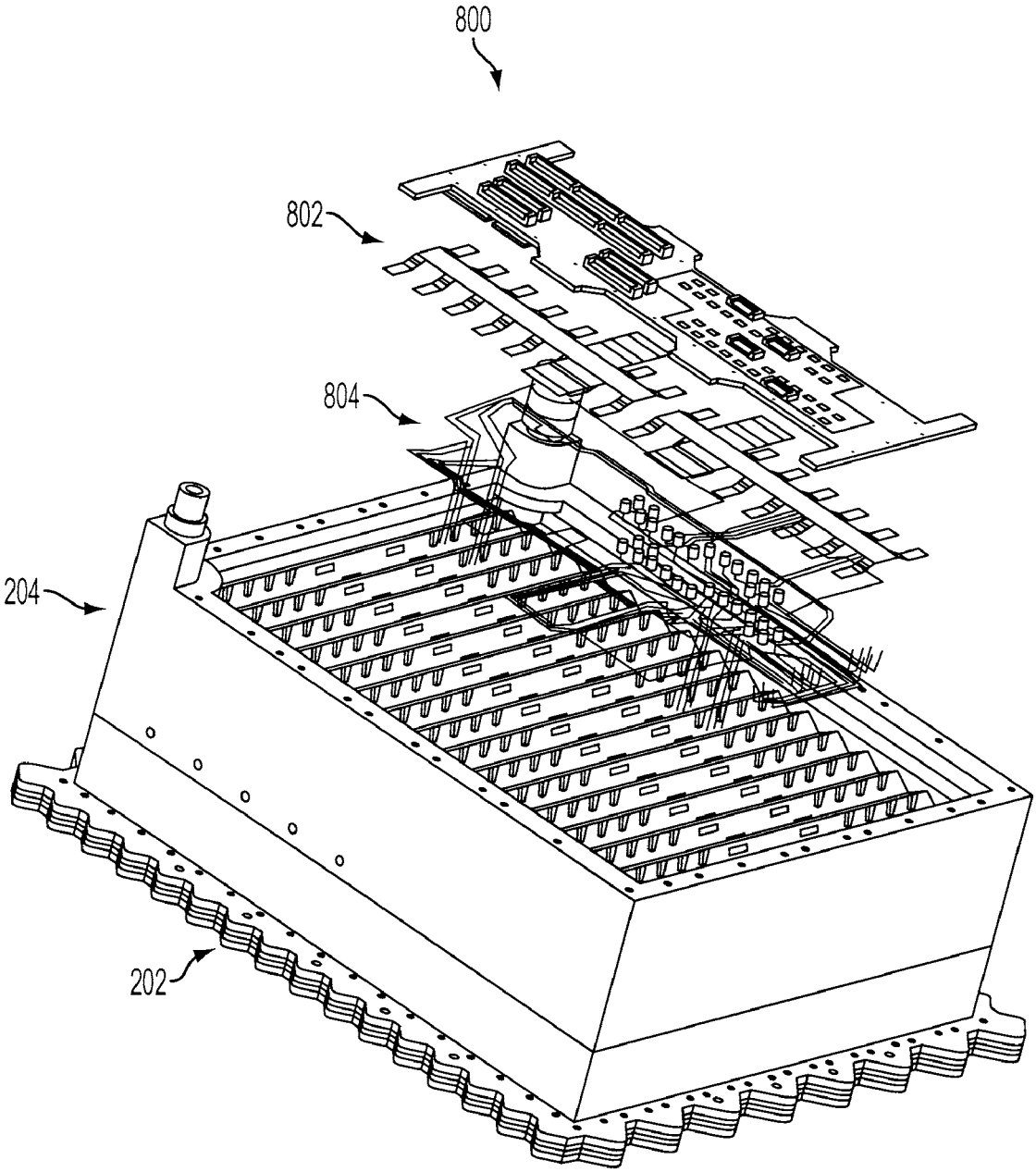
FIG. 8 is an isometric view of forward housing with an exploded view of certain rear housing components for use in an antenna subassembly according to an embodiment of the present invention.

FIG. 8 depicts the rear of an upper forward housing 204. An antenna subassembly 102 may have an aft housing 206 coupled to the forward housing. The aft housing 206 is a rectangular shape formed by a plurality of vertical members. The vertical members interlock with one another to form four walls. The vertical members attach to the aft side of the upper forward housing 204. In such an embodiment, a generally planar section of the upper forward housing 204 may have an aft portion that also forms part of the aft housing 206. The aft housing 206 may include a power supply, a removable cover 1000, an array driver, a coolant distribution manifold, a logic distribution assembly 800, a logic flex jumper assembly 802, an RF cable assembly 804, a power distribution assembly and a beam steering control module.

In one embodiment, a spider flex assembly 802 connects a beam steering controller, an array driver and an auxiliary power supply to a logic distribution assembly, or backplane 800. As discussed above, the term beam steering refers to changing the direction of the main lobe of the radiation pattern. Beams may be steered by changing which transmit/receive modules 700 are used, or, alternatively, beams may be steered by changing the relative phases of the various transmit/receive modules 700. Phase shifting is controlled by a beam steering control module, which produces logic signals that instruct a phase shifter to alter the phase of a transmitted RF signal. The logic signal is carried over the spider flex assembly 802 to a phase shifter included in a transmit/receive module 700. In one embodiment, a beam steering controller includes a memory module, a controller CPU module, an interface timing module, a beam computation module and array interface module. The array driver is coupled to the transmit layer of the RF manifold 602, and amplifies an RF signal that is sent by the transmit function of the transmit/receive module 700. The array drivers are connected to the RF manifold 602 via RF cables 804. The RF cables 804 also connect the RF manifold 602 to array I/O interface connector.

Figure 9:
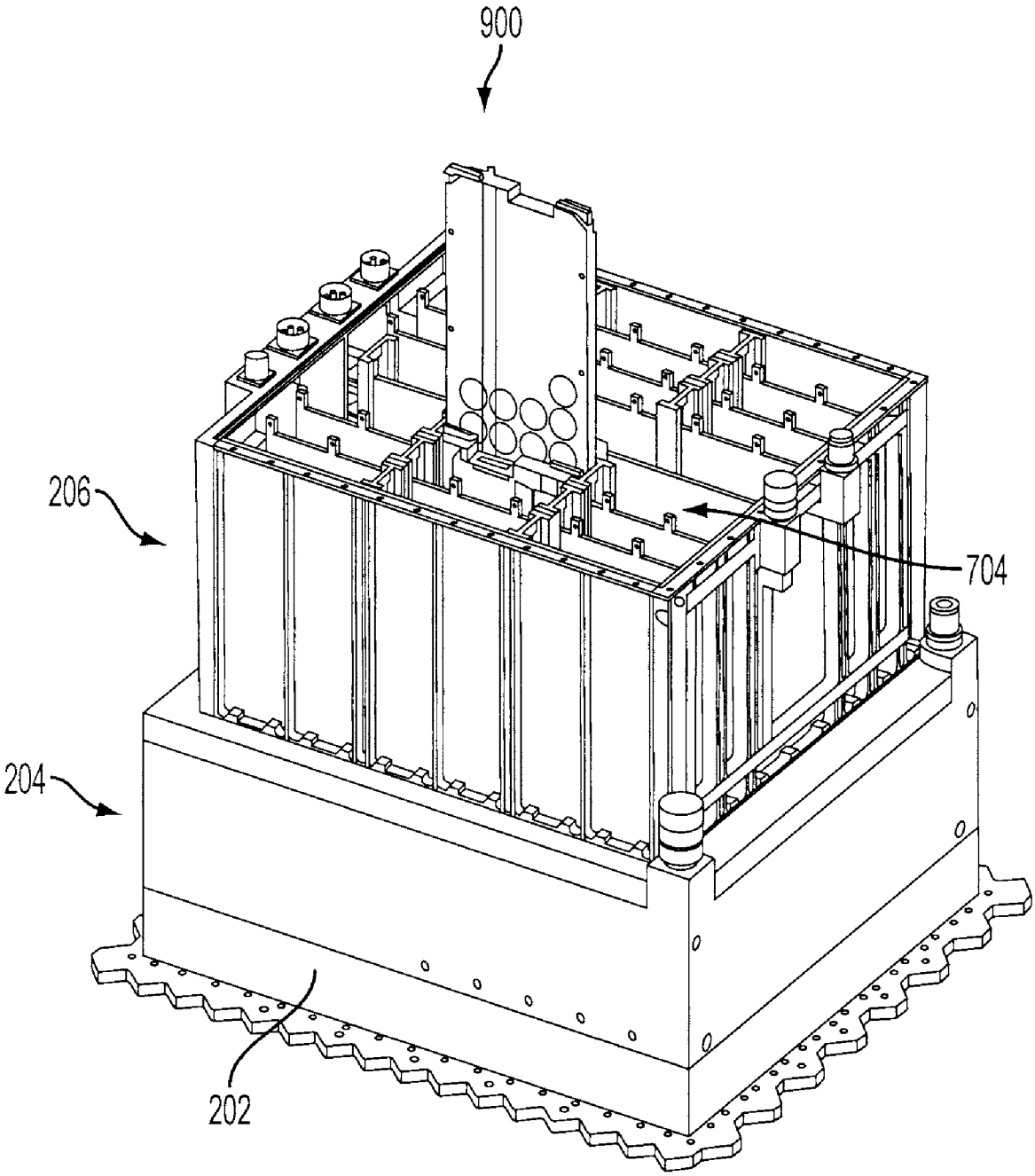
FIG. 9 is an isometric view of an antenna subassembly with a removed removable cover according to an embodiment of the present invention.

As shown in FIG. 9, the aft housing 206 may contain line replaceable units 900. A line replaceable unit 900 is an integrated component including a high voltage power supply, a low voltage power supply, an array driver, an auxiliary power supply, power filters and beam steering control modules. The line replaceable unit 900 is attached to the aft housing 206 with wedgelocks and ejectors. In such an embodiment, both removal and installation of line replaceable unit 900 is simplified. There may be a plurality of modular line replaceable units 900, such that if one line replaceable unit 900 fails, it can be replaced with another line replaceable unit 900 because the line replaceable units 900 are situated such that they can be removed from the rear of the antenna subassembly 102. An individual bus bar may be electrically connected to the high and low voltage power supplies, such that the power supplies can transfer power or high current to the power logic boards 702.

The aft housing 206 may contain coldplates 704 which remove heat from the line replaceable units 900. The aft housing 206 is manufactured such that it also functions as a coolant distribution manifold. The coolant may be coolanol, polyalpha olefin or another liquid media. The power distribution assembly is designed to carry 300V DC, and has the same layout as the logic distribution assembly 800. Both the power and logic distribution assemblies 800 connect to each of the line replaceable units 900 in an aft housing 206.

Figure 10:
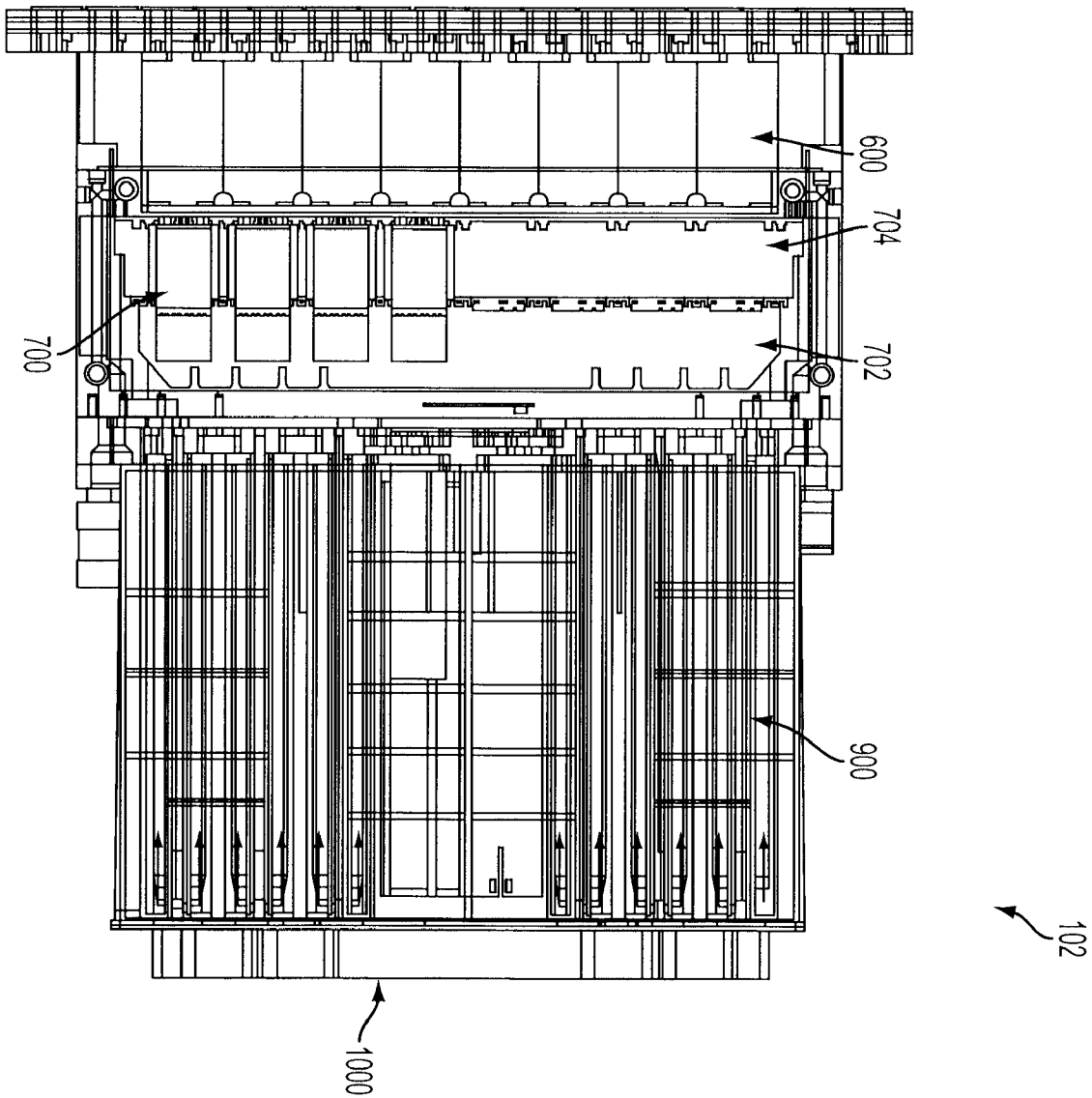
FIG. 10 is a section view of an antenna subassembly according to an embodiment of the present invention.

As depicted in FIG. 10, the aft housing 206 may have a removable cover 1000. In various embodiments, the cover 1000 may cover all or various portions of the back of the aft housing 206. The cover 1000 may be removed by: removing screws or bolts, by pivoting, operating a hinge, by pulling away a flap, or by undoing an interference fit, e.g. pulling it out. Removing the cover will allow a technician easy access to a line replaceable unit 900.

While this invention has been described in conjunction with specific embodiments thereof, many alternatives, modifications and variations will be apparent to those skilled in the art. Accordingly, the preferred embodiments of the invention as set forth herein, are intended to be illustrative, not limiting. Various changes may be made without departing from the true spirit and full scope of the invention as set forth herein.

What is claimed is:

1. An antenna subassembly for an active electronically scanned array, comprising:
- a patch radiator,
- a forward housing, coupled to the patch radiator, including:
  - a radio frequency manifold,
  - a plurality of transmit/receive modules, and
  - a circulator coupled to the radio frequency manifold, and
- an aft housing, coupled to the forward housing, including:
  - a power supply,
  - a removable covering,
  - an array driver, and
  - a beam steering control module.

2. The antenna subassembly of claim 1, where the power supply, the array driver and the beam steering control module form a line replaceable unit.

3. The antenna subassembly of claim 2, where the line replaceable unit is accessible after the removable covering has been removed.

4. The antenna subassembly of claim 2, where the power supply includes:
- a high voltage power supply;
- a low voltage power supply;
- an auxiliary power supply; and
- a power filter.

5. The antenna subassembly of claim 1, where the forward housing further comprises a lower forward housing and an upper forward housing.

6. The antenna subassembly of claim 5, where the circulator is housed in the lower forward housing, the plurality of transmit/receive modules are housed in the upper forward housing, and the lower forward housing is separable from the upper forward housing.

7. The antenna subassembly of claim 1, further comprising a bus bar coupled to the power supply.

8. The antenna subassembly of claim 1, further comprising a coldplate coupled to one of the plurality of transmit/receive modules.

9. The antenna subassembly of claim 1, where the transmit/receive modules are designed for high power applications.

10. The antenna subassembly of claim 1, where the patch radiator has a coincident phase center.

11. The antenna subassembly of claim 1, where the patch radiator has a plurality of polarizations.

12. The antenna subassembly of claim 1, where the circulator is a modular circulator.

13. The antenna subassembly of claim 1, where the forward housing includes a plurality of independent subarrays.

14. The antenna subassembly of claim 1, where the circulator may be accessed without draining of a liquid coolant.

15. An antenna assembly, comprising:
- a structural grid, including:
  - a plurality of continuous beam members,
  - a plurality of splices coupled to the continuous beam members and crossing over the top of, or under the bottom of, the plurality of continuous beam members, and
  - a plurality of discontinuous beam members coupled to the splices; and
- a front structure coupled to the structural grid, including:
  - a walkway, and
  - a radome coupled to the front structure;
- where each of the plurality of continuous beam members has one or more notches configured to allow the plurality of splices to cross over or under.

16. The antenna assembly of claim 15, where the radome is comprised of fiberglass.

17. The antenna assembly of claim 15, where at least one continuous beam member is substantially perpendicular to at least one discontinuous beam member.

18. The antenna assembly of claim 15, where at least one discontinuous beam member is substantially vertical.

19. The antenna assembly of claim 15, where the structural grid houses a plurality of antenna subassemblies, the subassemblies including:

a patch radiator, a forward housing, coupled to the patch radiator, including:

a radio frequency manifold, a plurality of transmit/receive modules, and a circulator coupled to the radio frequency manifold, and an aft housing, coupled to the forward housing, including:

a power supply, a removable covering, an array driver, and a beam steering control module.

20. The antenna assembly of claim 15, further comprising a plurality of radio frequency cables.

21. The antenna assembly of claim 15, where each of the plurality of discontinuous beam members is secured to:

(i) a continuous beam member of the plurality of continuous beam members, and (ii) a splice of the plurality of splices that is secured to the continuous beam member of the plurality of continuous beam members.

22. The antenna assembly of claim 15, where each of the plurality of discontinuous beam members is secured to:

(i) one splice of the plurality of splices that crosses over the top of one of the plurality of continuous beam members, and (ii) another splice of the plurality of splices that crosses under the bottom of the one of the plurality of continuous beam members.

23. The antenna assembly of claim 15, further comprising a plurality of antenna subassemblies assembled together on the structural grid to function as a larger antenna.

24. The antenna assembly of claim 23, where each of the plurality of antenna subassemblies comprises a patch radiator.

25. An antenna assembly for an active electronically scanned array, comprising:

a planar dual polarization, coincident phase center foam based patch radiator;

a lower forward housing, coupled to the patch radiator, having a first side and a second side with a first set of four walls, containing;

a plurality of modular circulators, coupled to the second side and surrounded by the first set of four walls;

an RF manifold coupled to the modular circulators;

an upper forward housing, having a first side coupled to the first set of four walls, and a second side with a second set of four walls, containing;

a plurality of coldplate and power logic board pairs, and each coldplate provides conductive cooling;

a plurality of S-Band transmit/receive modules coupled to each coldplate and power logic board pair, an aft housing, coupled to the upper forward housing, including:

a first side;

an assembly;

a coolant distribution manifold;

a removable cover;

a plurality of bus bars; and a plurality of line replaceable units coupled to the first side of the aft housing with wedgelocks and injectors, including:

a high voltage power supply;

a low voltage power supply;

an array driver;

an auxiliary power supply;

a power filter; and a beam steering control module.

* * * * *